United States Patent [19]

Masaki

[11] 4,344,401

[45] Aug. 17, 1982

[54] ELECTROSTATIC FUEL INJECTOR

[75] Inventor: Kenji Masaki, Yokohama, Japan

[73] Assignee: Nissan Motor Company, Limited, Japan

[21] Appl. No.: 711

[22] Filed: Jan. 3, 1979

Related U.S. Application Data

[62] Division of Ser. No. 778,944, Mar. 18, 1977, Pat. No. 4,173,206.

[30] Foreign Application Priority Data

Mar. 24, 1976 [JP] Japan ..... 51/31450
May 29, 1976 [JP] Japan ..... 51/61785

[51] Int. Cl.[3] ..... F02B 51/04; F02B 33/00; F02M 27/04; F02M 29/00

[52] U.S. Cl. ..... 123/536

[58] Field of Search ..... 123/119 E, 141, 119 R, 123/32 EA, 119 EC

[56] References Cited

U.S. PATENT DOCUMENTS

| | | | |
|---|---|---|---|
| 2,656,824 | 10/1953 | Devaux | 123/119 E |
| 2,766,582 | 10/1956 | Smith | 123/119 E |
| 3,841,824 | 10/1974 | Bethel | 123/119 E |
| 4,034,728 | 7/1977 | Saufferer | 123/119 E |
| 4,051,826 | 10/1977 | Richmens | 123/119 E |
| 4,064,852 | 12/1977 | Fulenwider | 123/119 E |
| 4,085,717 | 4/1978 | Willmann et al. | 123/119 E |

FOREIGN PATENT DOCUMENTS

| | | | |
|---|---|---|---|
| 2428967 | 1/1976 | Fed. Rep. of Germany | 123/119 E |
| 2433125 | 1/1976 | Fed. Rep. of Germany | 123/119 E |
| 2449848 | 5/1976 | Fed. Rep. of Germany | 123/119 E |
| 2521141 | 11/1976 | Fed. Rep. of Germany | 123/119 E |
| 714015 | 8/1954 | United Kingdom | 123/119 E |

*Primary Examiner*—Wendell E. Burns
*Attorney, Agent, or Firm*—Robert E. Burns; Emmanuel J. Lobato; Bruce L. Adams

[57] ABSTRACT

A fuel injector of the invention comprises a plurality of parallel, threadlike tubes for admitting electrostatically charged fuel and an accelerator electrode biased at the opposite potential to that applied to a fuel charging electrode. The fuel admitted through the parallel tubes is atomized at the outlet port of the tubes as a result of electrostatic repulsion between charged particles, and attracted and accelerated by an electrode spaced from the outlet port of the tubes. A control electrode may be provided spaced from the accelerator electrode adjacent to the outlet port of the tubes and biased at a potential with respect to the accelerator electrode much lower than the potential applied across the accelerator and fuel-charging electrodes. By varying the potential at the control electrode, the fuel quantity delivered can effectively be controlled.

13 Claims, 12 Drawing Figures

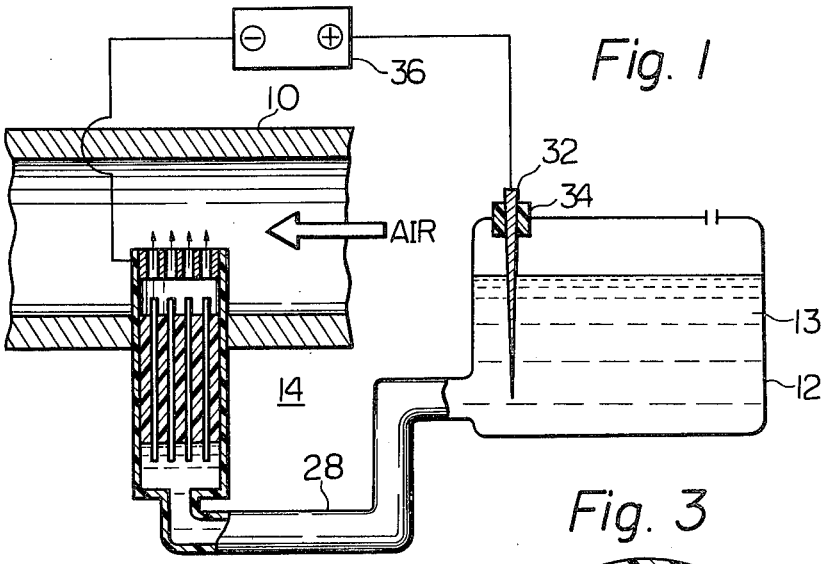
Fig. 1
Fig. 2
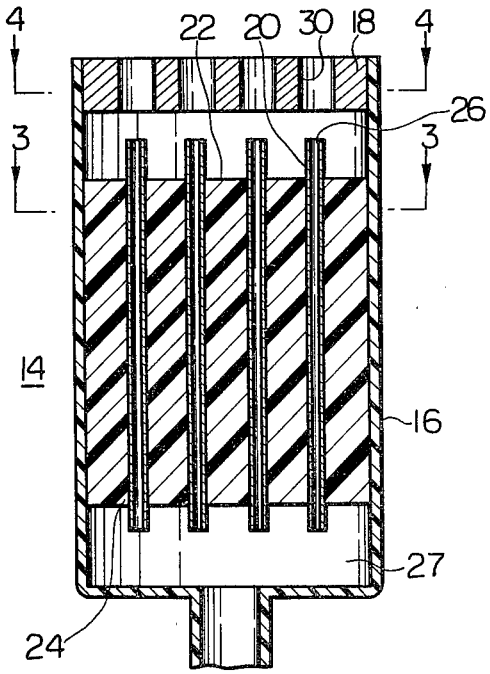
Fig. 3
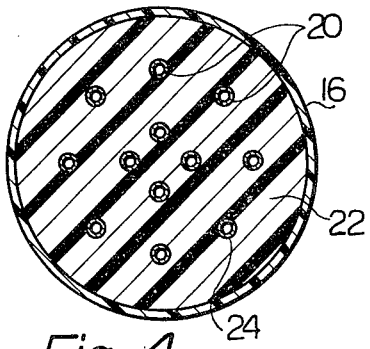
Fig. 4
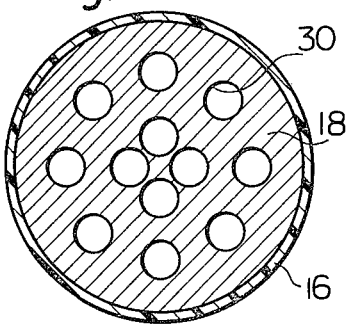

ELECTROSTATIC FUEL INJECTOR

This is a divisional, of application Ser. No. 778,944, filed Mar. 18, 1977 now U.S. Pat. No. 4,173,206.

FIELD OF THE INVENTION

The present invention relates generally to fuel injection, and particularly to electrostatic fuel injection in which fuel is ejected utilizing the principle of electrostatic repulsion and attraction.

BACKGROUND OF THE INVENTION

Conventional air-fuel delivery systems can be broadly divided into two types: carburetion and fuel injection. The carburetion system only permits the use of light fuel oil and is becoming increasingly complex in mechanism because of the need to meet the recent emission control requirements with the consequential increase in cost. Fuel injection for Diesel engines employs a fuel pump for compressing air and, at the point of maximum compression, heavy fuel oil is injected into the combustion chamber and ignition takes place as a result of the high temperature which has been created. In electronic fuel injection, and fuel injectors are essentially solenoid actuated on/off poppet valves incorporating pintles designed for metering and atomization of light fuel oil, which requires precision in machining and becomes costly in mass production.

SUMMARY OF THE INVENTION

An object of the present invention is to provide a novel fuel injection unit for combustion of a mixture of air and fuel operating under the principle of electrostatic repulsion and attraction.

Another object of the invention is to provide a fuel injection unit which is simple in construction and easy to regulate the amount of fuel to be injected.

A further object of the invention is to provide a fuel injection unit which is reliable in operation.

A further object of the invention is to provide a fuel injection unit which permits the use of both light and heavy fuel oils.

A further object of the invention is to provide a fuel injection apparatus for internal combustion engines in which the fuel injection unit is disposed in the air intake passage downstream of a throttle valve and the fuel supply source is communicated with the air intake passage for preventing the fuel from being drawn into the cylinder with the varying depression of pressure in the air intake passage.

One example of the fuel injection unit of the invention comprises a plurality of parallel, conductive tubes for passage of fuel and an apertured accelerator electrode spaced from the forward end of the tubes. A voltage source of the order of several kilovolts to several tens of kilovolts is provided to bias the accelerator electrode with respect to the tubes. The rearward end of the tubes is connected to a source of fuel. As the fuel is admitted through the tubes, the fuel is electrostatically charged and ejected from the forward end of the tubes at a high speed as a result of electrostatic attraction of the tubes. The ejected fuel tends to atomize into fine particles as a result of electrostatic repulsion between the charged particles, and then attracted and accelerated by the opposite potential at the accelerator electrode to a high speed and injected into an air intake passage of a combustion system through the aperture of the accelerator electrode to be mixed with the air induced.

A control electrode is preferably provided rearwardly spaced from the accelerator electrode adjacent to the forward end of the tubes. The control electrode is biased at a potential with respect to the accelerator electrode at a much lower potential than that applied across the accelerator and fuel-charging electrodes. By varying the control potential, the fuel quantity delivered to intake passage can be accurately controlled.

The fuel may be alternatively charged by providing a fuel-charging electrode in the source of fuel so that the fuel is electrostatically charged prior to the passage through the ejection tubes. The fuel passage tubes may in turn be constructed of a nonconductive material, which can avoid electrostatic spark discharge which would otherwise occur when the conductive tubes are biased at the opposite potential to the accelerator electrode.

BRIEF DESCRIPTION OF THE DRAWINGS

FIG. 1 illustrates an embodiment of the invention with a fuel injection unit of the invention shown disposed in an air intake passage of a combustion system;

FIG. 2 is an enlarged cutaway view of the fuel injection unit of FIG. 1;

FIG. 3 is a cross-sectional view taken along the lines 3—3 of FIG. 2;

FIG. 4 is a cross-sectional view taken along the lines 4—4 of FIG. 2;

DESCRIPTION OF THE PREFERRED EMBODIMENTS

Figure 5:
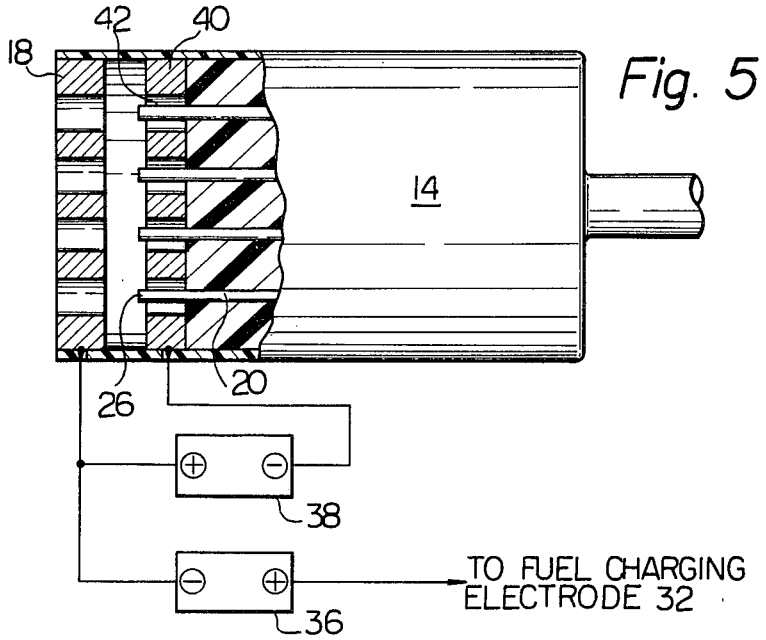
FIG. 5 illustrates a modification of the fuel injection unit of the invention with the unit shown partly cutaway for illustration.

Referring now to FIG. 1, an embodiment of the present invention is illustrated as an example for use with air-fuel mixture combustion systems having an air intake pipe 10 and a fuel supply source or container 12 for holding fuel 13. A fuel injection unit 14 of the invention, which is separately shown in FIG. 2 for clarity, comprises a cylindrical housing 16, an apertured electrode 18 disposed at the upper end of the housing 16 and a plurality of parallel fuel delivery nozzles 20. A cylindrical body 22 of molded plastic is disposed in the housing 16 and formed with a plurality of parallel cylindrical bores 24 as shown in FIG. 3. Each nozzle 20 is formed by a conductive tubular member which extends into the bore 24 of the cylindrical body 22 to form a fuel delivery orifice 26 at the upper end thereof adjacent to the electrode 18. The lower end of each nozzle extends into a fuel cavity 27 formed at the lower end of the housing and is connected by means of a conduit 28 to the fuel supply source 12. As clearly shown in FIG. 4, the electrode 18 is provided with cylindrical apertures 30 each of which is coaxially aligned with each fuel delivery nozzle 20. The inner diameter of each nozzle 20 may be chosen at a suitable value so long as it is much smaller than its length as will be understood as the description proceeds, a typical value of the inner diameter being 0.3 to 1.0 millimeter, which is also smaller than the diameter of aperture 30 of the accelerator electrode 18.

A sharply pointed electrode 32 is mounted by an insulating bushing 34 and extends into the fuel contained in the source 12, and connected to a positive terminal of a voltage source 36. The negative terminal of the voltage source is connected to the accelerator electrode 18. The voltage source 36 has a high tension voltage of from several kilovolts to several tens of kilovolts. The fuel is thus electrostatically charged at a positive potential and the charged fuel is led through the conduit 28 to be admitted through each nozzle 20. Because of the smaller transverse dimension of each nozzle than its longitudinal dimension, there occurs a repulsive force in the nozzles 20 in the direction of their length so that the fuel therein is caused to leave from the orifices 26 toward electrode 18. The fuel is then attracted and accelerated by the electrode 18, allowed to pass through the electrode apertures 30, and injected to the interior of the intake pipe 10. When the potential difference is of the order of several kilovolts, the fuel is ejected in the form of parallel continuous threadlike streams, and with the increase in voltage the fuel begins to atomize at the fuel delivery orifices 26 as a result of the electrostatic repulsion between particles of the same polarity. When the potential is removed, the fuel ceases to be ejected from the orifices. According to experiments, it was found that the fuel injection unit 14 of the invention can respond to the interruption of the source voltage within a period of 10 to 20 milliseconds, and the fuel is ejected at a speed of 10 meters per second.

FIG. 5 illustrates a modification of FIG. 1 in which a second, or control electrode 40 is mounted inwardly from the accelerator electrode 18 adjacent to the fuel delivery orifices 26. The control electrode 40 is provided with a plurality of cylindrical apertures 42 each of which is coaxially aligned with the nozzle 20. The control electrode 40 is biased at a negative potential relative to the accelerator electrode 18 by means of a second voltage source 38 of the order of several hundreds volts. The provision of such control electrode has the effect of lowering the potential at the accelerator 18 with respect to the potential at the electrode 32 while the rate of fuel quantity ejected at the orifices 26 is retained.

Because of the electrostatic repulsion which causes the ejected fuel to atomize into fine particles, the fuel injector of the invention permits the use of any type of fuel including light and heavy fuel oil and liquid propane gas (LPG).

Figure 6:
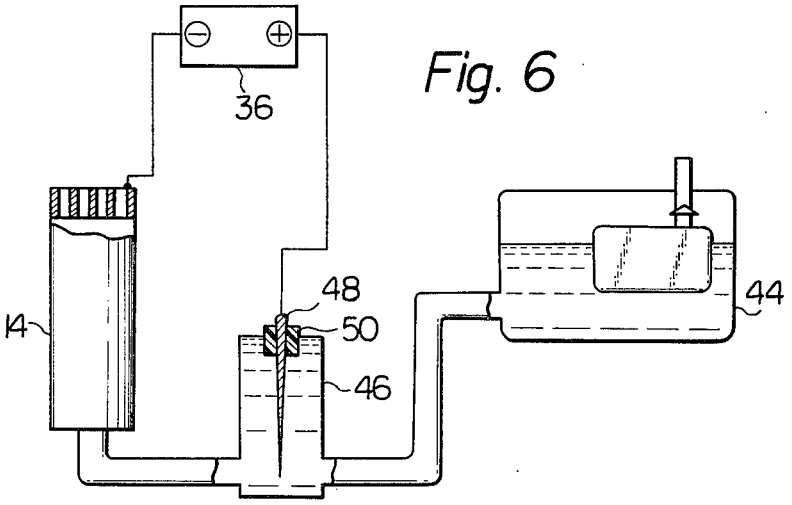
FIGS. 6 to 8 show alternative arrangements of the invention.

Fuel can be electrostatically charged in various ways as illustrated hereinbelow. In FIG. 6, the fuel supply source 44 is a conventional floating chamber used in automotive engines and an intermediate fuel tank 46 is connected between the fuel source 44 and the fuel injection unit 14. A pointed electrode 48 is immersed in the fuel contained in the tank 46 by an insulating mounting or bushing 50 and connected to the positive terminal of the voltage source 36. This separate arrangement of the charging tank 46 from the fuel supply source would facilitate replacement of conventional fuel injectors with the injection unit of the invention by allowing the use of the existing fuel supply source and additionally ensure optimum insulation planning for the various equipments used by locating the charging tank 46 at any suitable place.

Figure 7:
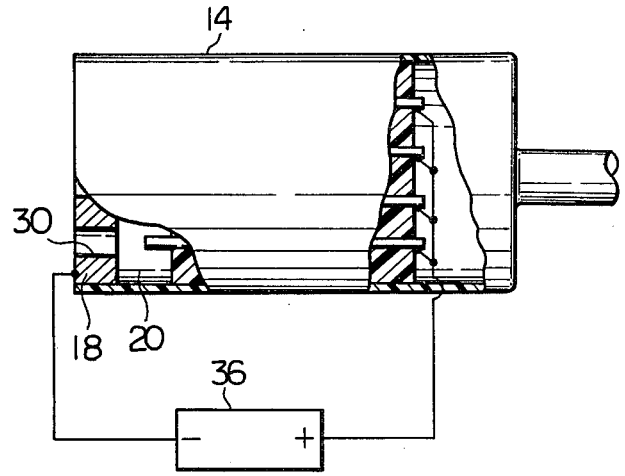

The fuel delivery nozzles 20 can be electrically connected together as illustrated in FIG. 7 to the positive terminal of the voltage supply 36. In this case care must be exercised to ensure against electrostatic spark discharge across the accelerator electrode 18 and the opposite end of each fuel nozzle 20, for example, by enlarging the transverse dimension of the electrode apertures 30. In this case, the spacing between the accelerator electrode 18 and the fuel delivery orifices 26 should be chosen to ensure against electrostatic spark discharge therebetween. This high potential connection to the nozzles 20 may be effected in combination with the connection of the same potential to the electrode 32 of the fuel supply source 12. In this instance, the charging effect of the fuel is further enhanced.

Figure 8:
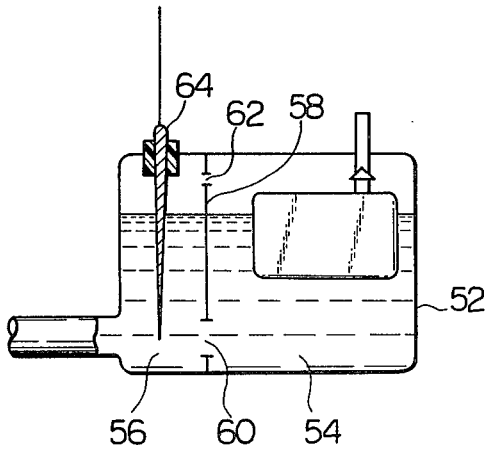

In automobile applications, the fuel charging chamber may be provided in a manner as illustrated in FIG. 8 in which a floating chamber 52 is divided substantially into a fuel inlet portion 54 and a fuel outlet portion 56 by means of a partition 58. The fuel in the chamber 54 is communicated with the outlet chamber 56 by a channel or aperture 60 in the dividing partition 58. The air-filled portion of the outlet chamber is communicated with the inlet chamber by an opening 62 provided in the partition 58. A charging electrode 64 is immersed in the fuel in the outlet chamber portion 56. This arrangement has the effect of strongly charging that portion of fuel volume which is only admitted to the injection unit 14. Also, the use of a sharply pointed electrode provides a high gradient electric field adjacent to the pointed end which prevents delivery of insufficiently charged fuel to the injection unit 14.

Figure 9:
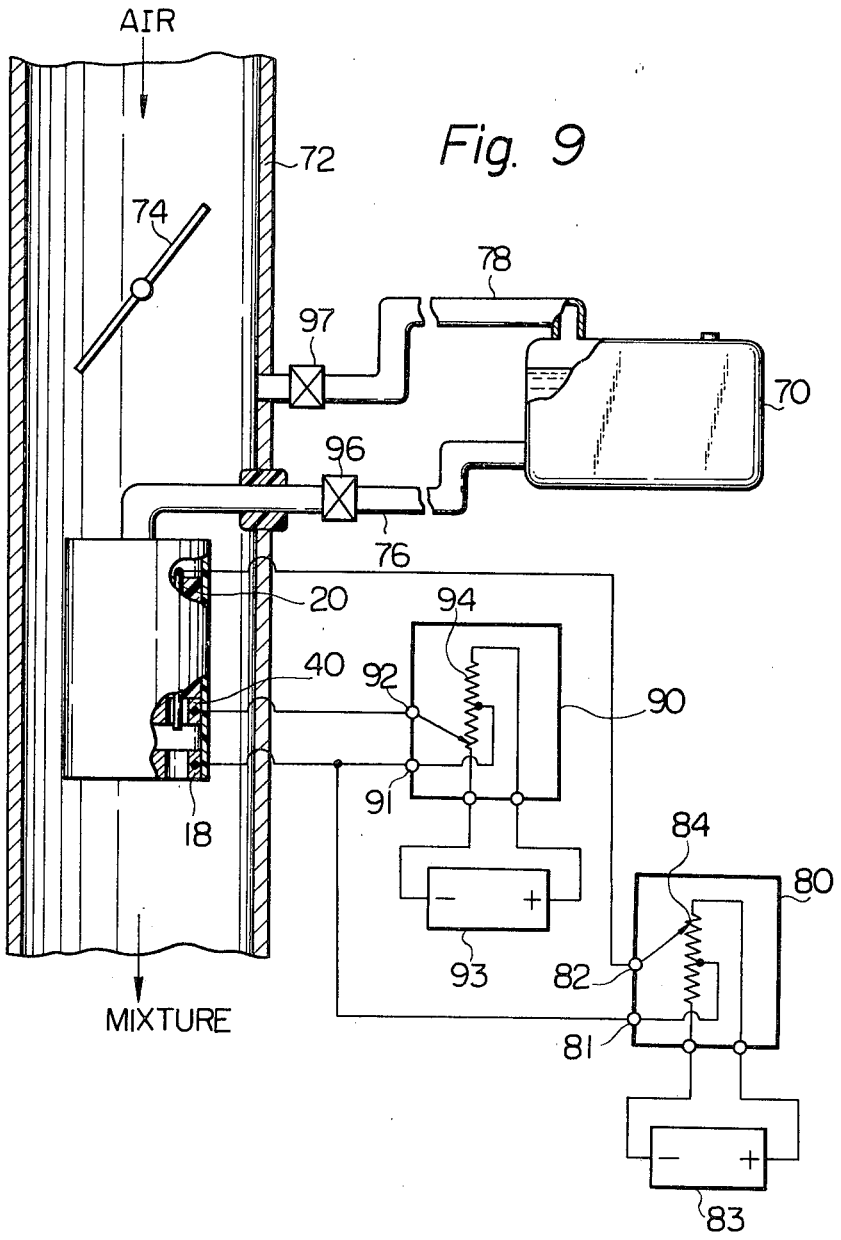
FIG. 9 illustrates a fuel injection apparatus embodying the invention for an internal combustion engine.

For practice of the present invention, FIG. 9 illustrates an example of applications to automotive vehicles having a floating chamber 70 and an air intake pipe 72 with a throttle valve 74 disposed therein in conventional manner. The injection unit 14 of the invention is disposed in the intake pipe 72 at the downstream side of the throttle valve 74 such that the fuel is ejected in a direction directly opposite to the throttle valve and connected to the floating chamber 70 via conduit 76.

In the prior art carburetion system, the main fuel nozzle is provided at the upstream side of the throttle valve so that a portion of the delivered fuel vapor is intercepted by the throttle valve and liquefied, or in some cases the flow of air-fuel mixture is disturbed and consequently the homogneity of the mixture is lost. By positioning the fuel injection unit 14 of the invention at the downstream side of the throttle valve 74, it is possible to overcome the above-mentioned problems. However, due to the depression of pressure in the intake pipe the fuel tends to be drawn from the fuel delivery orifices 26 and the amount of the fuel drawn by the vacuum is proportional to the engine load. Thus, the fuel delivered to the engine cylinder varies with the engine load. This is undesirable where the fuel injection unit 14 is intended to be operated by biasing potentials applied to its electrodes. For this purpose, the downstream side the throttle valve 74 is communicated with the air-filled portion of the floating chamber 70 by means of conduit 78 so that the fuel in the floating chamber is at equilibrium and prevented from being affected by the engine load.

In accordance with the invention, the accelerator electrode 18 is connected to a first terminal 81 of a first control circuit 80 and the tubular nozzles 20 are connected together to a second terminal 82 of the control circuit 80 to electrostatically charge the fuel passing therethrough. Of course, the electrostatic charging of fuel is also effected in a manner as described in connection with FIG. 6 or 8. The accelerator electrode 18 is also connected to a first terminal 91 of a second control circuit 90 and the control electrode is connected to a second terminal of the control circuit 90.

For purposes of illustration, the first control circuit 80 is schematically shown as comprising a high voltage source 83 and a potentiometer 84 connected at opposite ends to the positive and negative terminals of the voltage source 83 with a point intermediate the ends of the potentiometer resistance element being connected to the first terminal 81. The wiper tap of the potentiometer 84 is connected to the second terminal 82. The accelerator electrode 18 is thus at a neutral point with respect to the potentials at the terminals 81 and 82. When the wiper tap is positioned halfway down the neutral point, the accelerator electrode 18 is made positive with respect to the fuel charging electrode, in this case, the nozzles 20, and conversely when the wiper tap is positioned halfway up the neutral point, the situation is reversed. In so far as there exists a potential difference between the accelerator electrode and the fuel charging electrode, fuel is delivered from the nozzles in the form of atomized particles if such potential difference is great enough to effect atomization. The sense of polarity of the two electrodes is of no significance if the control electrode 40 is not provided.

Similarly, the second control circuit 90 is schematically shown as comprising a low source 93 and a potentiometer 94 having its resistance element connected at opposite ends to the positive and negative terminals of the voltage source 93 and its wiper terminal connected to terminal 92. The intermediate point of the resistance element is connected to the first terminal 91. Assuming that the accelerator electrode 18 is biased negative with respect to the charging electrode 20 with the wiper terminal of the potentiometer 84 being positioned halfway up the neutral point, the application of a negative bias potential to the control electrode 40 with respect to the accelerator electrode 18 increases the amount of fuel delivered from the nozzles 20. The delivered fuel quantity decreases with the decrease in the potential difference between the accelerator and control electrodes. On the other hand, the application of a positive bias potential to the control electrode 40 by positioning the wiper terminal of the potentiometer 94 to halfway up the neutral point the amount of delivered fuel decreases and the amount of decrease is proportional to the positive potential level of the control electrode with respect to the accelerator electrode. Therefore, it will be understood that with the accelerator potential made constant with respect to the fuel charging electrode 20, the variation of the potential at the control electrode 40 serves to control the fuel quantity to be delivered to the engine cylinders, and that an alternating voltage serves the purpose of fuel control. It is obvious to those skilled in the art to design the details of such control circuit 90 which provides an output signal whose amplitude is related to various engine operating parameters in a manner identical to the conventional electronic fuel injection system.

Fuel control is also effectively provided by varying the potential across terminals 81 and 82 and its polarity in conjunction with the variation of the potential and polarity of the terminals 91 and 92.

The arrangement of FIG. 9 further includes electromagnetic valves 96 and 97 disposed in the passage of conduit 76 and conduit 78, respectively. These electromagnetic valves may be operated in response to the combustion cycle of the engine. This prevents the possibility of the fuel being ejected upon rapid depression of pressure of great magnitude such as encountered when the vehicle is suddenly decelerated.

Figure 10:
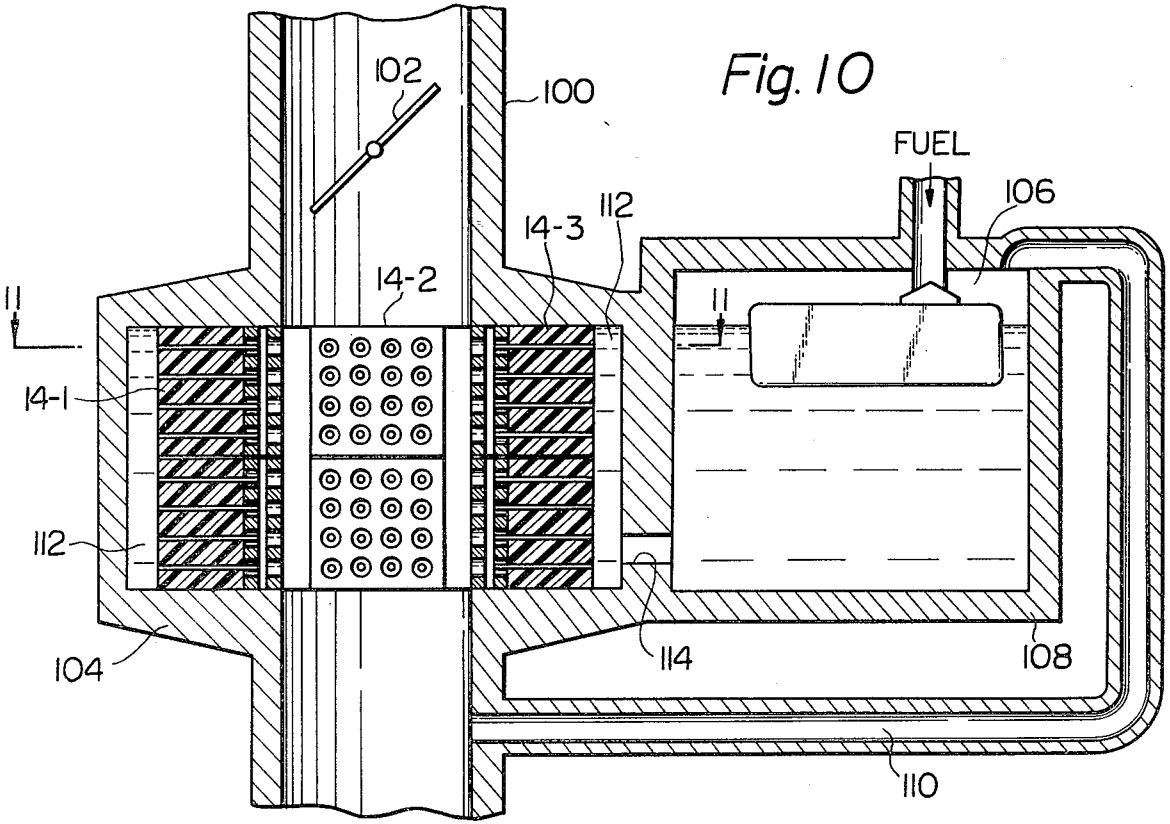
FIG. 10 illustrates a modification of the embodiment of FIG. 9.
Figure 11:
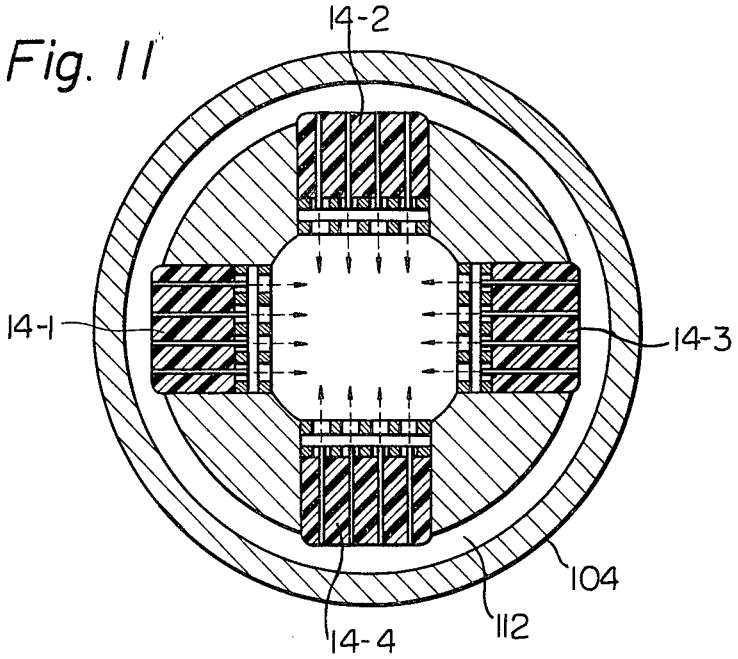
FIG. 11 is a cross-sectional view taken along the lines 11—11 of FIG. 10.

The injected fuel quantity may be increased in proportion to the number of cylinders by mounting a plurality of injection units. In FIG. 10, a portion of the induction pipe 100 downstream of a throttle valve 102 is enlarged in radial directions to form a housing 104 and a floating chamber 106 is formed by a housing 108 which is in communication with the induction pipe 100 by way of a conduit 110. Each injection unit is constructed of a cubic housing as illustrated and a plurality of such units are radially arranged in the housing 104 with the ejection side facing inwardly of the induction pipe and stacked one upon another in the longitudinal direction of the pipe 100 (see also FIG. 11). The rear end of each injection unit is spaced from the inner wall of the housing 104 to provide a chamber 112. Fuel is admitted through a channel 114 provided in the wall of the housing 104 to the chamber 112. The application of control signals to the injection units can be achieved in a stepwise manner such that at a given instant only one unit is fed with the control signal and the number of excited units is increased at intervals until required fuel quantity is reached. In this manner, a wide range of fuel control can be accurately achieved.

Figure 12:
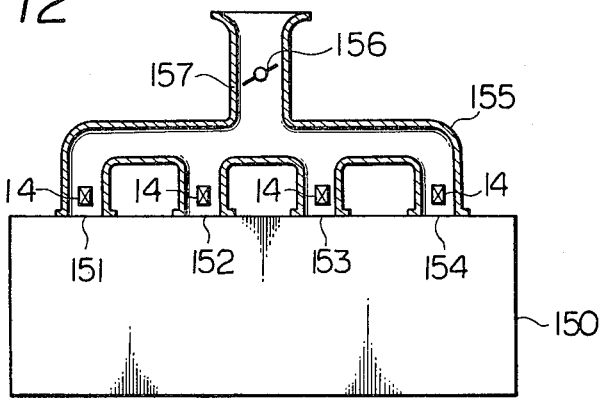
FIG. 12 illustrates an arrangement of the fuel injection units of the invention in a multi-cylinder internal combustion engine.

FIG. 12 depicts an example in which the fuel injection units of the invention are provided one for each intake port of the cylinder of a multi-cylinder internal combustion engine 150. The engine 150 has four intake ports 151 to 154 each of which is connected to the common air intake port through an intake manifold 155 with a throttle valve 156 disposed in the common intake section 157. Fuel injection units 14 of the invention are disposed one in each intake port of the manifold 155 adjacent to the intake port of the corresponding cylinder. This arrangement is favorable for closed-loop mixture control systems because the delay time from the injection of fuel to the sensing of an exhaust composition can be reduced.

What is claimed is:

1. A fuel injection apparatus for combustion system, comprising:

a fuel supply container;

means for electrostatically charging said fuel;

a plurality of open-ended threadlike tubes arranged parallel with each other and connected at one end to said fuel supply container to allow said fuel to pass therethrough for delivery of fuel from the opposite end of each of said tubes; and means for electrostatically attracting and accelerating the fuel delivered from said threadlike tubes.

2. A fuel injection apparatus as claimed in claim 1, wherein said fuel charging means comprises a first electrode immersed in said fuel supply container, and said accelerating means comprises a second electrode spaced from the opposite end of each of said threadlike tubes, and means for biasing said first and second electrodes at different potentials.

3. A fuel injection apparatus as claimed in claim 1, wherein each of said threadlike tubes is formed of a conductive material, and said accelerating means comprises an electrode spaced from the opposite end of each of said threadlike tubes, and means for biasing said conductive tubes and said electrode at different potentials.

4. A fuel injection apparatus as claimed in claim 1, wherein said accelerating means comprises an apertured electrode having a plurality of apertures each being coaxially aligned with each of said threadlike tubes.

5. A fuel injection apparatus as claimed in claim 4, further comprising a second apertured electrode having a plurality of apertures each being coaxially aligned with each aperture of said first-mentioned electrode, said second electrode being spaced from said first electrode adjacent to the opposite end of each of said threadlike tubes, and means for biasing said second electrode with respect to said first electrode.

6. An air-fuel mixing device for internal combustion engines having an air intake passage, a throttle valve in said passage and a floating chamber containing fuel, comprising:

a fuel injection unit disposed in said air intake passage downstream of said throttle valve, comprising:

a plurality of open-ended threadlike tubes arranged parallel with each other and connected at one end to said floating chamber to allow said fuel to pass therethrough for delivery of fuel from the opposite end of each of said tubes; and an electrode spaced from the opposite end of each of said threadlike tubes;

means for electrostatically charging said fuel at a first potential level and biasing said electrode at a second potential level; and means for communicating the interior of said intake passage downstream side of said throttle valve with the air-filled portion of said floating chamber.

7. An air-fuel ming device as claimed in claim 6, wherein said electrode is provided with a plurality of apertures equal in number to said threadlike tubes, and wherein each of said tubes is coaxially aligned with each of said apertures.

8. An air-fuel mixing device as claimed in claim 6, further comprising a second electrode spaced from the first-mentioned electrode adjacent to the opposite end of each of said threadlike tubes, said second electrode being biased at a third potential level.

9. An air-fuel mixing device as claimed in claim 6, wherein said threadlike tubes are formed of conductive material and biased at said second potential level.

10. An air-fuel mixing device as claimed in claim 6, wherein said fuel injection units are mounted radially on the circumference of said air intake passage.

11. An air-fuel mixing device as claimed in claim 6, further comprising an electromagnetic valve interposed in the passage leading from said floating chamber to said fuel injection unit for controlling the flow of said fuel at periodic intervals.

12. An air-fuel mixing device as claimed in claim 6, wherein said internal combustion engine is of a multi-cylinder type, and said fuel injection units are each mounted adjacent to respective one of the cylinder of the engine.

13. An air-fuel mixing device as claimed in claim 6, wherein said charging means comprises an electrode immersed in said floating chamber and electrically connected to a source of potential.

* * * * *